United States Patent [19]

Pehr

[11] Patent Number: 5,013,073

[45] Date of Patent: May 7, 1991

[54] AUTOMATIC RESET WINDOW LATCH

[76] Inventor: Harold T. Pehr, 3920 W. 96th St., Overland Park, Kans. 66207

[21] Appl. No.: 523,047

[22] Filed: May 14, 1990

Related U.S. Application Data

[63] Continuation-in-part of Ser. No. 277,288, Nov. 29, 1988, Pat. No. 4,925,041, which is a continuation of Ser. No. 160,571, Feb. 26, 1988, Pat. No. 4,787,526.

[51] Int. Cl.[5] ..... F05C 3/14

[52] U.S. Cl. ..... 292/87; 292/DIG. 38; 292/DIG. 47

[58] Field of Search ..... 292/87, 816.38, DIG. 47, 292/80, 89

[56] References Cited

U.S. PATENT DOCUMENTS

| | | | |
|---|---|---|---|
| Re. 29,793 | 10/1978 | Pehr . | |
| 351,769 | 11/1886 | Wentschke et al. . | |
| 545,778 | 9/1895 | Cough | 292/87 |
| 690,440 | 1/1990 | Kemp | 292/87 |
| 764,493 | 7/1904 | Noseworthy | 292/87 |
| 1,038,199 | 9/1912 | Rast | 292/87 |
| 1,242,391 | 10/1917 | Ulrich | 292/87 |
| 1,587,037 | 6/1926 | Rudolph | 292/87 |
| 1,868,949 | 7/1932 | Pat | 292/87 |
| 3,623,622 | 11/1971 | Sullivan . | |
| 3,790,015 | 2/1974 | Imamura . | |
| 3,826,394 | 7/1974 | Stull . | |
| 3,830,391 | 8/1974 | Uhlig . | |
| 3,830,393 | 8/1984 | Schaefer . | |
| 3,871,662 | 3/1975 | Happ et al. . | |
| 3,894,647 | 7/1975 | Montgomery . | |
| 4,127,221 | 11/1978 | Vere . | |
| 4,170,315 | 10/1979 | Dubach et al. . | |
| 4,244,495 | 1/1981 | Lorschied et al. . | |
| 4,353,483 | 10/1982 | Pehr . | |
| 4,501,378 | 2/1985 | Berfield | 292/DIG. 38 |
| 4,787,526 | 11/1988 | Pehr | 215/216 |
| 4,923,230 | 5/1990 | Simpson | 292/DIG. 47 |
| 4,925,041 | 5/1990 | Pehr | 215/216 |

*Primary Examiner*—Eric K. Nicholson

*Attorney, Agent, or Firm*—Litman, McMahon & Brown

[57] ABSTRACT

A window latch mechanism having first and second closure members for attachment to respective first and second double-hung windows. Hingeably attached to the first closure member is a tongue having a distal tooth. When the closure members are in an open configuration thereof, the tongue may be selectively rotated about a hinge to an easy open position or to a vertical ready-to-latch position. The first closure member also includes a vertically extending biasing wall adjacent to a base of the tongue. The second closure member includes a bar positioned to be overlapped by the tooth when in a closed and locked position thereof. The mechanism also includes at least one restraining boss positioned opposite the bar relative to the tongue for selectively allowing the tongue to be biased away from the bar and interferringly held by the boss away from the bar in a closed but unlatched position to allow the windows to be opened.

7 Claims, 2 Drawing Sheets

Fig. 5.
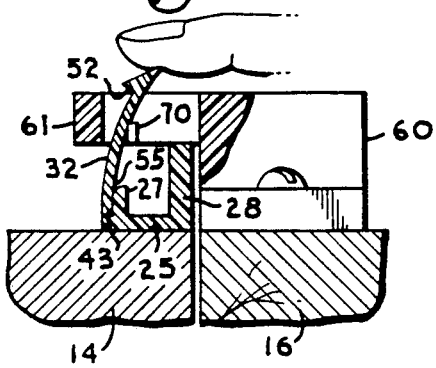
Fig. 6.
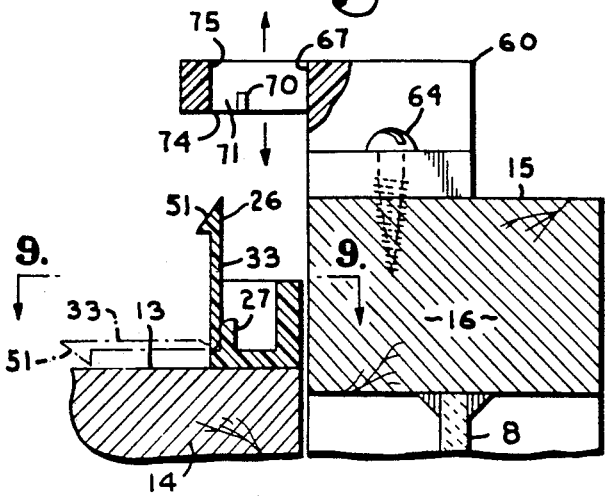
Fig. 7.
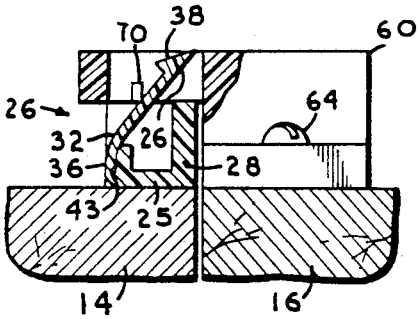
Fig. 8.
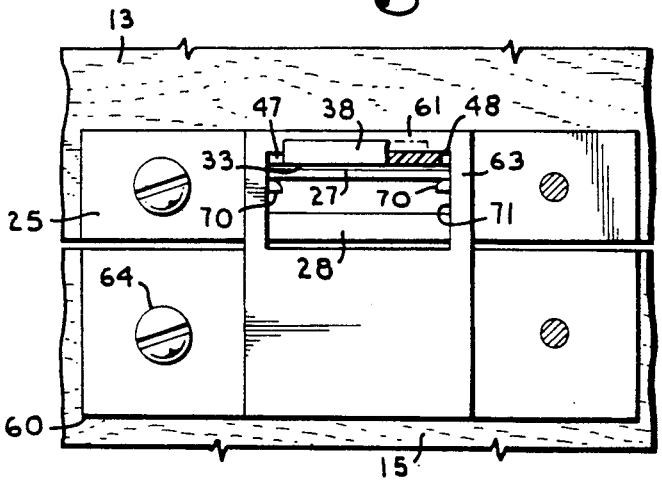
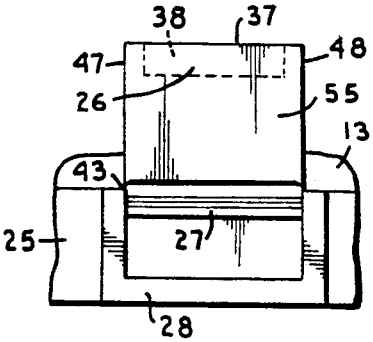
Fig. 9.
Fig. 10.
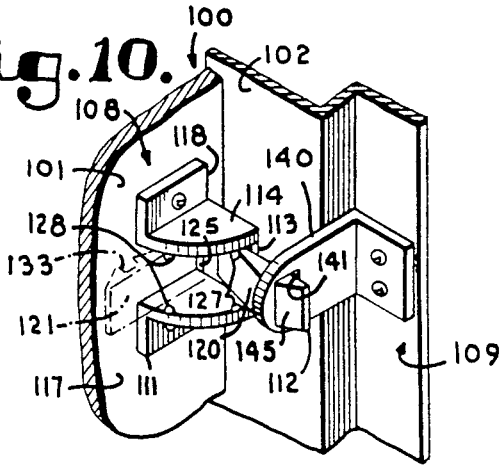

AUTOMATIC RESET WINDOW LATCH

CROSS-REFERENCE TO RELATED APPLICATIONS

The present application is a continuation-in-part of U.S. patent application Ser. No. 277,228, filed Nov. 29, 1988, entitled CLOSURE FOR CONTAINER, now U.S. Pat. No. 4,925,041, which was a continuation of U.S. patent application Ser. No. 160,571, filed Feb. 26, 1988, entitled CONTAINER CLOSURE, now U.S. Pat. No. 4,787,526.

BACKGROUND OF THE INVENTION

The present invention relates to latching mechanisms for windows or doors and, in particular, to such a latching mechanism having a bipositional latch which may selectively be placed in an automatic latching position such that when the window or door to which the latching mechanism is attached is shut, the latching mechanism is automatically engaged or in an easy opening position. When in the latching position, the latching mechanism requires the user to first bias the latch over a boss or the like to be secured in an unlatched position before the window or door can be opened.

Unlocked windows present a myriad of safety concerns for the typical home dweller. Besides providing easy access for intruders and burglers, unlocked windows present a danger to small children who may open and fall out of such unlocked windows, especially from upper floors. Most conventionally used locking mechanisms for windows require an individual to take affirmative steps to lock the window once it has been unlocked and opened. Locking mechanisms have been developed which automatically lock and secure a window each time it is closed. Such locking mechanisms typically require that an individual attempting to open a window initially urge a biasable latching means away from an engaging surface and simultaneously lift the window to an open position. As the window is shut, the biasable latching means is biased back into an engaging alignment with the engaging surface thereby locking the window. Such automatic latching mechanisms present some serious practical disadvantages. For most windows, especially windows that tend to stick, a latching mechanism which requires the simultaneous biasing of a latching means while lifting the window would be impractical, because the use of both hands to lift the window would typically be required. Also, the inability to shut a window without the locking mechanism engaging to lock the window would be inconvenient in situations where a window must be repeatedly opened and closed in a short period of time, such as for maintenance, outside window cleaning or other situations.

Therefore, it is desirable to develop a locking mechanism for windows which may be selectively placed in an automatic locking reset position such that when a window is closed, the locking mechanism automatically locks the window. It is desirable that such a locking mechanism allows an individual wishing to open a window to initially disengage the locking mechanism so that the individual may use both hands to open the window. It is also desirable that the locking mechanism may be taken out of the automatic locking reset position such that each time the window is shut, the locking mechanism does not automatically lock the window.

SUMMARY OF THE INVENTION

The present invention provides a latching mechanism especially adapted for use with a double-hung window having an inner window and an outer window slidably and adjacently mounted within a window frame. Typically, the inner window occupies a lower half of the frame and the outer window occupies an upper half of the frame such that an upper surface of an upper rail on the inner window is aligned with an upper surface of a lower rail on the outer window. The latching mechanism comprises a first mating portion and a second mating portion. The first mating portion is securely mounted to the upper surface of the lower rail of the outer window and the second mating portion is secured to the upper surface of the upper rail of the inner window.

The first mating portion includes a plate which is bolted to the upper surface of the lower rail of the outer window and a biasable tongue which is hingedly connected to a frontal edge of the plate. The tongue generally comprises a front surface and a back surface, as well as a hinged end and a distal end. A triangular barb or tooth generally extends across the front surface of the tongue near the distal end. The tongue is selectively pivotal about a hinge at a lower end thereof so as to be positionable so as to extend perpendicular to the upper surface of the lower rail of the outer window or so as to extend generally horizontal to the upper surface. A biasing wall extends perpendicularly from the plate mounted on the upper surface so as to be adjacent to the back surface of the tongue when the tongue is aligned so as to be perpendicular to the upper surface.

The second mating portion comprises a second plate bolted to the upper surface of the upper rail of the inner window and a rectangular projection which extends over the upper surface of the lower rail of the outer window. The projection includes a rectangular channel or aperture extending therethrough for receiving the tongue. The rectangular aperture is defined by a frontal surface, a rearward surface and a pair of opposed lateral surfaces, each having a lower edge and an upper edge.

A boss is positioned on each lateral surface near the lower edge a distance away from the frontal surface of the aperture which is preferably equal to or greater than the maximum width of the tongue at the barb.

When it is desired to place the latching mechanism in an automatic latching reset position, the tongue is positioned so as to extend perpendicular to the upper surface of the lower rail of the outer window. The inner window should then be lowered from a raised position. As the inner window is lowered from a raised position, the lower edge of the front surface of the aperture engages the triangular barb on the tongue thereby biasing the tongue backwards against the biasing wall towards the rear surface of the aperture. As the inner window is continually lowered, the barb passes between the front surface of the aperture and an imaginary line connecting the opposingly-mounted bosses. As a lower surface of the barb reaches the upper edge of the front surface of the aperture, the tongue is biased forward by the natural resiliency thereof and by action of the biasing wall acting thereon, so that the lower surface of the barb extends above and in overlapping and engaging relationship with an upper surface of the rectangular projection of the second mating portion.

To raise the inner window, the lower surface of the barb must be taken out of engaging relationship with the upper surface of the rectangular projection of the second mating portion. A manually generated force is applied to the barb so as to bias the tongue towards the rear surface of the aperture. The biasing force should be enough to urge the tongue over and to pass beyond the opposing bosses. Once the tongue has been biased past the bosses, the biasing force is released and the bosses interferingly prevent the tongue from returning to a perpendicular alignment with the first plate in response to the biasing force exerted on the tongue by the biasing wall. With the tongue removed from an engaging relationship with the rectangular projection of the second mating portion, the inner window may be raised using both hands. As the inner window is raised, the bosses are lifted away from the tongue so as to allow the tongue to be biased by the perpendicular wall back into perpendicular alignment with the upper surface of the lower rail of the outer window, so that when the inner window is lowered again, the tongue will be biased into engaging relationship with the upper surface of the rectangular projection of the second mating surface, thereby placing the inner and outer windows in closed and latched relationship with respect to each other.

When it is desired for the window to open without interference from or manipulation of the tongue during opening and, in particular, so that the tongue does not biasingly engage the second mating portion every time the inside window is closed, the tongue is placed in generally horizontal alignment with the upper surface of the lower rail of the outer window. Then, when the inside window is lowered from a raised position, the tongue does not biasingly engage the second mating portion of the latching mechanism.

OBJECTS OF THE INVENTION

Therefore, the objects of the present invention are: to provide a latching mechanism for closure surfaces that is alternatively adjustable to an automatic reset latching position and a nonautomatic reset latching position; to provide such a latching mechanism which includes a bipositional and resilient tongue with an outwardly projecting tooth or barb on a distal end thereof and with an opposite end thereof hingedly connected to a first latching member, such that when the closure members are placed in a closed position and the bipositional tongue is placed in an automatic reset latching position, the barb of the tongue overlaps and biases against a surface of a second latching member so as to prevent the opening of the closure members; to provide such a latching mechanism which allows the tongue to be removed from an engaging relationship with a second latching member and to be maintained in a nonengaging relationship with the second latching member while the closure surfaces are placed in an open relationship relative to each other; to provide such a latching mechanism which can be manufactured separately from the closure surfaces; to provide such a latching mechanism which can be adapted for use with various closure surfaces, including windows, doors and various lids for containers, especially where multiple latching mechanisms are required for a container; to provide such a latching mechanism which is relatively inexpensive to manufacture, easy to use and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is an enlarged, fragmentary and cross-sectional view of the latching mechanism secured to the double-hung window in the closed position similar to FIG. 4, but showing a bipositional biasable tongue being urged into a nonengaging position thereof.

FIG. 6 is an enlarged, fragmentary and cross-sectional view of the latching mechanism secured to the double-hung window in the open position similar to FIG. 4, showing the tongue in an automatic latching position in solid lines and a nonlatching position in phantom lines.

FIG. 7 is an enlarged, fragmentary and cross-sectional view of the latching mechanism secured to the double-hung window in the closed position similar to FIG. 4, showing the bipositional tongue in a disengaged position.

FIG. 8 is an enlarged and fragmentary, top plan view of the latching mechanism with portions broken away to show detail thereof.

FIG. 9 is an enlarged, fragmentary and cross-sectional view of the latching mechanism, taken along line 9—9 of FIG. 6.

FIG. 10 is a perspective view of a modified embodiment of the latching mechanism of the present invention secured to a door and frame.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
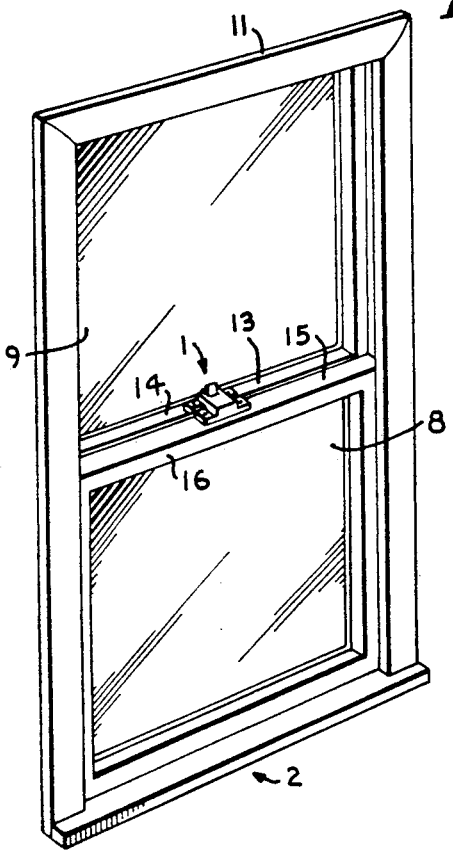
FIG. 1 is a perspective view of the latching mechanism of the present invention secured to a double-hung window in a closed position.
Figure 2:
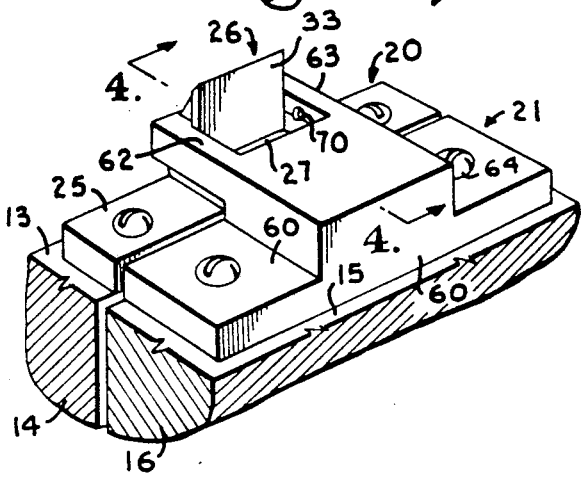
FIG. 2 is an enlarged and fragmentary perspective view of the latching mechanism secured to the double-hung window in the closed position.
Figure 3:
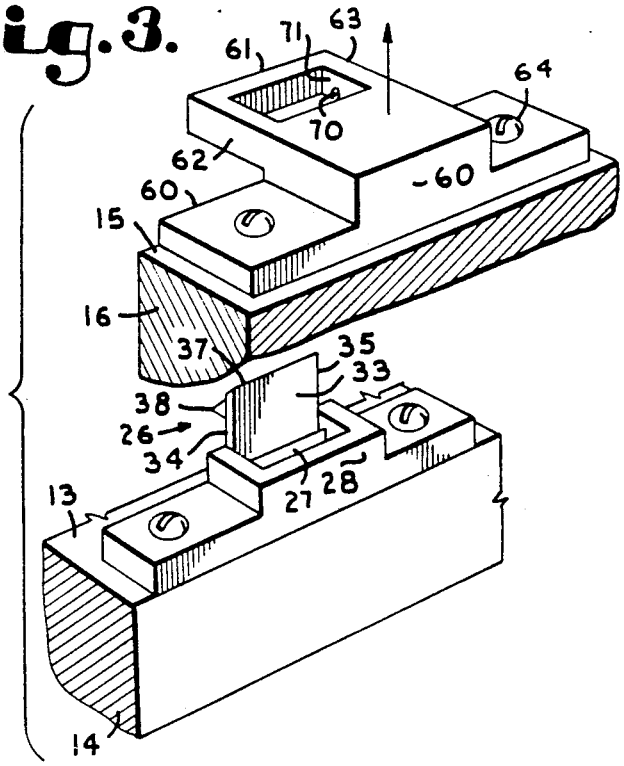
FIG. 3 is an enlarged and fragmentary perspective view of the latching mechanism secured to the double-hung window in an open position.

FIGS. 1 through 9 illustrate a latching mechanism in accordance with the present invention, generally designated by the reference numeral 1 and secured to a double-hung window 2. As used herein, the terms "upper", "lower", "front", "back" and the like refer to the direction provided in the description of the drawings and, in particular, "front" is to the left in FIG. 4, although it is foreseen that the invention can be easily modified to different directional configurations. The double-hung window 2, as shown in FIG. 1, generally comprises an inner window 8 and an outer window 9 slidably mounted within a frame 11. When the double-hung window 2 is positioned in a closed alignment such that the inner window 8 occupies a lower half of the frame 11 and the outer window 9 occupies an upper half of the frame 11, a first upper surface 13 of a lower rail 14 of the outer window 9 is planarly aligned with a second upper surface 15 of an upper rail 16 of the inner window 8.

The latch mechanism 1 comprises a first latch member 20 and a second latch member 21. The first latch member 20 is secured to the first upper surface 13 and the second latch member 21 is secured to the second upper surface 15.

The first latch member 20 comprises a first lower attachment plate 25, a biasable elongate tongue 26, an upstanding biasing wall 27, and a support structure 28. The first plate 25 is secured to the first upper surface 13 by bolts, screws or the like. The biasable elongate tongue 26 has a front surface 32, a rear surface 33, a first outer or lateral side 34, a second outer or lateral side 35, a lower end 36, an upper end 37 and a tooth or barb 38.

The tongue 26 is connected near a front edge 42 of the first plate 25 by a flexible hinge 43. Where the latching mechanism 1 is constructed of plaster or the like, the hinge 43 may be molded integrally with the plate 25 and the tongue 26, and where partially or completely constructed of nonpliable materials, the hinge 43 may be a separate mechanical hinge mechanism.

The barb 38 extends partially across the front surface 32 of the tongue 26 along the upper end 37 and is spaced away from the first outer edge 34 and the second outer edge 35 so as to form a first unobstructed path 47 extending along the front surface 32 of the tongue 26 between the barb 38 and the first outer edge 34 and a second unobstructed path 48 extending across the front surface 32 of the tongue 26 between the barb 38 and the second outer edge 35. The barb 38 comprises a cam surface 51 sloping downward from the upper end 37 of the tongue 26 to an innersection with a lower barb surface 52 extending perpendicularly away from the front surface 32 of the elongate tongue 26.

The hinge 43 allows the tongue 26 to be positioned in a generally perpendicular alignment with the first plate 25 and the first upper surface 13 or, alternatively, in a horizontal alignment with the first plate 25 and the first upper surface 13 so as to extend away from the front edge 42 of the first plate 25. The biasing wall 27 extends perpendicular to the first plate 25 and is positioned so that when the tongue 26 is positioned in a perpendicular alignment with the first plate 25, the biasing wall 27 abuttingly engages a lower portion of the rear surface 33 of the tongue 26.

The second latch member 21 comprises a second securing plate 60, a latching bar 61, a first support arm 62 and a second support arm 63. The second plate 60 is secured to the second upper surface 15 of the upper rail 16 of the inner window 8 by fastening means such as screws 64, bolts or the like. The bar 61 is spaced away from the second plate 60 by the first and second support arms 62 and 63 so as to define a tongue receiving aperture 67 therebetween. The aperture 67 is slightly wider than the tongue 26 from the first side 34 to the second side 35 and extends completely across the plate 25 so that the bar 61 is positioned so as to extend just beyond the front surface 32 of the tongue 26 when in a latching position thereof.

A nub, bump or boss 70 is positioned on an inner surface 71 of both the first and second support arms 62 and 63. The bosses 70 are spaced away from the bar 61 a distance slightly greater than the width of the barbed portion of the tongue 26.

In use, the latching mechanism 1 is selectively positionable in an automatic latch reset position (solid lines for tongue 26 in FIG. 6) or a nonautomatic latch reset position (phantom lines for tongue 26 in FIG. 6). In the automatic latch reset position, the tongue 26 is positioned so as to extend perpendicular to the first plate 25.

With the latching mechanism 1 in the automatic reset latch position, as the inner window 8 is advanced from an open position to a closed position (downward in FIG. 6), a lower inner edge 74 of the bar 61 engages the cam surface 51 of the barb 3S on the tongue 26 so as to bias the tongue 26 backwards against the biasing wall 27, thereby directing the tongue 26 through the aperture 67 between the bar 61 and an imaginary line passing through the bosses 70. When an upper inner edge 75 of the bar 61 reaches the lower barb surface 52 of the barb 38, the tongue 26 is biased forward by inherent resiliency and the biasing wall 27, so that the lower barb surface 52 is advanced into an engaging relationship with the bar 61.

To advance the inner window 8 to an open position, the tongue 26 must be biased backwards so that the lower barb surface 52 is advanced out of engaging relationship with the bar 61. To restrain the tongue 26 from being repositioned back into engaging relationship with the bar 61, the tongue 26 is manually urged over the restriction of the bosses 70 and backwards beyond the bosses 70, so that when the force that biased the tongue 26 backwards is released, the bosses 70 engage the front surface 32 of the tongue 26 and interferingly prevent the tongue 26 from being biased back into an engaging relationship with the bar 61 by the force exerted on the tongue 26 by the biasing wall 27. With the tongue 26 maintained in a nonengaging relationship with respect to the bar 61 by the bosses 70, both hands of a user can be used to lift the inner window 8. As the inner window 8 is lifted, the bosses 70 are advanced out of engaging relationship with the front surface 32 of the tongue 26. The biasing force exerted by the biasing wall 27 against the tongue 26 then is unopposed by the bosses 70 and biases the tongue back into a perpendicular alignment with the plate 25. As the bosses 70 are lifted away from the tongue 26, the front surface 32 of the tongue 26 is continually biased against the bosses 70 until the bosses 70 completely pass above the tongue 26. The first and second unobstructed paths 47 and 48 allow the bosses 70 to pass across the front surface 32 of the tongue 26 without engaging the barb 38.

Because the tongue 26 is biased back into a perpendicular alignment with the plate 25 each time the inner window 8 is advanced to an open position, the tongue 26 will biasingly engage the bar 61 each time the inner window 8 is advanced to a closed alignment when the latch mechanism 1 is positioned in an automatic latch reset position. It is foreseen that, when required, an interference means, such as another boss or the like, may be utilized to prevent the tongue 26 from moving between the solid and phantom line positions shown in FIG. 6 without manual pressure from a user. To place the latch mechanism in a nonautomatic latch reset position, the tongue 26 is simply advanced to a horizontal alignment with the first plate 25 (phantom lines in FIG. 6). Thereafter, when the inner window 8 is advanced to a closed alignment, the bar 61 does not engage the tongue 26 and the tongue 26 does not biasingly engage the bar 61.

Figure 4:
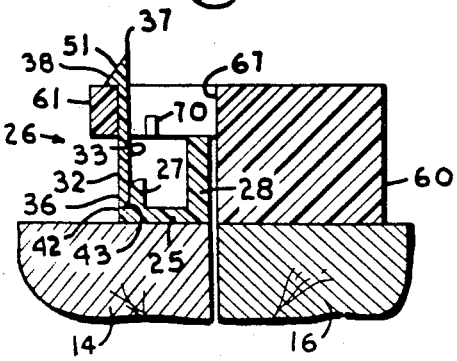
FIG. 4 is an enlarged, fragmentary and cross-sectional view of the latching mechanism secured to the double-hung window in the closed position, taken along line 4—4 of FIG. 2.

It is foreseen that the latching mechanism 1 may be arranged in various configurations not shown or described herein. For instance, the windows 8 or 9 to which the latch members 20 and 21 are secured could be switched so that the first latch member 20 would be secured to the inner window 8 and the second latch member 21 would be secured to the outer window 9 with appropriate modifications. Also, the elongate biasable tongue 26 could be positioned so as to extend in a sideways direction as opposed to the frontal direction, as is shown in FIG. 4.

It is also foreseen that the latch mechanism 1 of the present invention could be used with various closure surfaces. In particular, FIG. 10 discloses a latch mechanism 100 adapted for use with a door 101. The door 101 forms a closure surface with a door frame 102. The latch mechanism 100 generally comprises a first latch member 108 secured to the door 101 and a second latch member 109 secured to the door frame 102. The first latch member 108 generally comprises a first plate 111, a biasable tongue 112, a biasing wall 113, and side walls 114. The first plate 111 is secured to an inner surface 117 of the door 101 near an edge of the door which comes into aligned relation with the door frame 102 when the door 101 is placed in a closed relation.

The biasing wall 113 extends perpendicular to the first plate 111 along an outer edge 11S of the first plate 111 which is closest to the door frame 102 when the door 101 is placed in a closed alignment. The elongate biasable tongue 112 includes a front surface 120 and a rear surface 121. The tongue 112 is connected along a lower edge to the first plate 111 by a hinge 125 in such a manner that the tongue 112 may be rotated from a generally horizontal alignment with the door 101 to a perpendicular alignment with the door 101 such that when the tongue 112 is perpendicularly aligned with the door 101, the rear surface 121 of the tongue 112 abuts against the biasing wall 113. The width of the biasing wall is slightly larger than the width of the biasable tongue 112 and the side walls 114 enclose the space through which a lower portion of the tongue 112 travels when hingedly advanced from a perpendicular alignment with the door 101 to a horizontal alignment with the door 101.

A first set of bosses 127 extend from the inner surfaces of the side walls 114 and are positioned such that they interferingly abut against the front surface 120 of the tongue 112 when the tongue 112 is placed in a perpendicular alignment with the door 101. A second set of bosses similarly extend from the inner surface of the side walls 114 and are positioned so as to interferingly abut against the rear surface 121 of the tongue 112 when the tongue is positioned in a horizontal alignment with the door 101.

The distal end of the tongue 112 extends beyond the biasing wall 113 when the tongue 112 is positioned in a perpendicular alignment with the door 101 and includes a rectangularly-shaped recess 133 extending across the front surface 120 of the tongue 112. The second latch member 109 generally comprises an elongate plate 140 securedly mounted to the door frame 102 such that the elongate plate 140 extends perpendicular to the door plate 102. A rectangular aperture extends through the elongate plate 140 near a distal end thereof. The elongate plate 140 and the rectangular aperture 141 are positioned such that when the tongue 112 is perpendicularly aligned with the door 101 and the door 101 is advanced from an open alignment to a closed alignment, a cam surface 145 on the distal end of the tongue 112 engages the elongate plate 140 in such a manner that the tongue 112 is biased against the biasing wall 113 and directed through the aperture 141 of the elongate plate 140. As the rectangularly-shaped recess 133 passes through the rectangular aperture 141, the tongue 112 is biased by the biasing wall 113 into engaging relationship with the elongate plate 140. To open the door 101 when the tongue 112 is in engaging relationship with the elongate plate 140, the tongue 112 must be biased out of an engaging relationship with the plate 140 and then the door 101 may be swung open.

If it is desired that the tongue 112 not engage the elongate plate 140 each time the door 101 is closed, the tongue 112 should be advanced to a horizontal alignment with the door 101 and held in place by the second set of bosses 128.

It is also foreseen that the latching mechanism of the present invention could be used for securing lids to boxes and other containers wherein a plurality of latching mechanisms could be used to secure the lid to such a container with the advantage of being hard to operate by children, since knowledge of the latching mechanism is required to place multiple mechanisms in a nonengaged position prior to opening such a container. Such latching mechanisms would be positionable in an automatic reset position and a nonautomatic reset position.

It is to be understood that while certain forms of the present invention have been illustrated and described herein, it is not to be limited to the specific forms or arrangement of parts described and shown.

What is claimed and desired to be secured by Letters Patent is as follows:

1. A latching mechanism adapted for use with a first closure member and a second closure member alternatively positionable in a closed alignment and an open alignment comprising:

(a) an elongate tongue connected at one end to the first closure member and having a barb extending outwardly from said tongue at an opposite end from where said tongue is connected to said first closure member;

(b) a bar attached to the second closure member and positioned such that when said first and second closure members are advanced to a closed alignment, said barb engages and overlaps said bar in an engaging relation so as to prevent said first and second closure members from being advanced to an open alignment;

(c) biasing means biasing said barb in engaging relation with said bar when said first and second closure members are in a closed alignment so as to resist the placement of said barb in a nonengaging relation with said bar;

(d) restraining means for selectively maintaining said barb in said nonengaging relation with said bar after said barb has been advanced out of said engaging relation with said bar so as to allow said first and second closure members to be advanced to an open alignment;

(e) automatic release means automatically releasing said barb from said restraining means when said first and second closure members are advanced to an open alignment so as to allow said barb to automatically engage said bar in said engaging position when said first and second closure members are subsequently advanced to a closed alignment.

2. The latching mechanism according to claim 1 wherein:

(a) said elongate tongue is further selectively positionable in a nonautomatic reset latching position, when said closure members are in the open alignment thereof, wherein said barb of said tongue does not engage said bar in an engaging relation when said first and second closure members are advanced to the closed alignment thereof.

3. The latching mechanism according to claim 1 wherein:

(a) said biasing means comprises a rigid and upright backing wall positioned adjacent a lower portion of said tongue and extending along said tongue when said tongue is in a locking alignment thereof.

4. The latching mechanism according to claim 1 wherein:

(a) said restraining means comprises a boss positioned to frictionally interfere with rearward movement of said tongue and to hold said tongue in a nonlocking alignment thereof.

5. In a latching mechanism for a first closure member and a second closure member alternatively alignable in a closed alignment and an open alignment having a biasable latch that biasingly engages an opposing latch member in an engaging relation when said first and second closure members are aligned in a closed alignment, so as to prevent said first and second closure members from being advanced to an open alignment until said biasable latch is biased out of said engaging relation with said opposing latch member, the improvement comprising:

(a) restraining means for maintaining said biasable latch in an nonengaging relation with said opposing latch member; and (b) automatic release means automatically releasing said biasable latch from said restraining means when said first and second closure members are advanced to an open alignment thereof so that said biasable latch automatically and biasingly engages said opposing latch member when said first and second closure members are subsequently advanced to a closed alignment thereof.

6. The improved latching mechanism according to claim 5 wherein:

(a) said biasable latch is alternatively positionable in an automatic latch reset position and a nonautomatic latch reset position, such that: when said biasable latch is positioned in said automatic latch reset position, said biasable latch is positioned so as to biasingly engage said opposing latch member each time said first and second closure members are advanced to a closed alignment; and, when said biasable latch is positioned in said nonautomatic latch reset position, said biasable latch is positioned so that said biasable latch does not engage said opposing latch member when said first and second closure members are advanced to a closed alignment.

7. A latch mechanism adapted for use with a double-hung window comprising an inner window and an outer window adjacently aligned within a window frame such that a first upper surface on a lower rail of said outer window extends adjacent to a second upper surface on an upper rail of said inner window when said double-hung window is in a closed alignment, wherein said latch mechanism comprises:

(a) an elongate biasable tongue having a lower end adapted to be hingedly connected to said first upper surface, an upper end, a first outer side, a second outer side, a front surface, a rear surface and a barb extending partially across said upper end of said front surface and spaced away from said first outer side so as to define a first unobstructed path extending between said first outer side and said barb;

(b) a biasing wall extending perpendicular to said first upper surface and positioned so as to abuttingly engage a lower portion of said rear surface of said elongate biasable tongue when said elongate biasable tongue is hingedly positioned in a perpendicular alignment with said first upper surface;

(c) a tongue receiving member comprising a base plate adapted to be secured to said upper surface of said upper rail of said inner window and a cross bar positioned away from said base plate by a pair of support arms having opposed inner surfaces such that said bar, said support arms and said base plate define a tongue receiving aperture extending therebetween, said bar and said aperture being located such that when said elongate biasable tongue is positioned so as to extend perpendicular to said first upper surface and said inner window is adapted to be advanced to a closed alignment, said bar biasingly engages a cam surface of said barb so that said tongue is urged away from said bar and passes through said aperture and is thereafter biased into overlapping and engaging relation with an upper surface of said bar so that said tongue must be biased away from said bar so as to allow advancement of the inner window to an open alignment;

(d) a boss positioned on one of said opposed inner surfaces of said support arms so that when said inner window is in a closed alignment and said tongue is biased out of an engaging relationship with said bar and across said boss, said boss interferingly engages said front surface of said tongue so as to prevent said tongue from being biased into engaging relation with said bar in response to a biasing force exerted on said tongue by said biasing means, said boss having dimensions such that, when said inner window is advanced to an open alignment while said boss interferingly engages said front surface of said tongue, said boss advances along said front surface of said tongue and along said unobstructed path so that said boss does not engage said barb, and when said boss is advanced completely away from said front surface of said tongue said biasing means biases said tongue into a perpendicular alignment with said first upper surface; and (e) said elongate biasable tongue is selectively also hingedly advanceable to a horizontal alignment with said first upper surface so that said tongue does not biasingly engage said bar, when said inner window is advanced to a closed position.

* * * * *